US007749060B1

(12) United States Patent
Olmes, III et al.

(10) Patent No.: US 7,749,060 B1
(45) Date of Patent: Jul. 6, 2010

(54) METHOD AND SYSTEM FOR PLAYING A GAME WITH MATCHING PIECES AND A BONUS SCORE

(76) Inventors: Frank S. Olmes, III, 714 Elane Way, Benicia, CA (US) 94510; Michael Anthony Short, 1955 Les Lunas St., Pasadena, CA (US) 91107

( * ) Notice: Subject to any disclaimer, the term of this patent is extended or adjusted under 35 U.S.C. 154(b) by 538 days.

(21) Appl. No.: 11/761,952

(22) Filed: Jun. 12, 2007

(51) Int. Cl.
*A63F 9/24* (2006.01)

(52) U.S. Cl. ..... 463/11; 273/273

(58) Field of Classification Search ..... 273/273
See application file for complete search history.

(56) References Cited

U.S. PATENT DOCUMENTS 5,411,271 A * 5/1995 Mirando ..... 463/9
5,855,513 A * 1/1999 Lam ..... 463/9
6,669,559 B1 * 12/2003 Baerlocher et al. ..... 463/16
6,964,416 B2 * 11/2005 McClintic et al. ..... 273/273
2007/0205556 A1 * 9/2007 Roemer et al. ..... 273/273
2007/0281781 A1 * 12/2007 Kennedy ..... 463/25

* cited by examiner

*Primary Examiner*—Dmitry Suhol
*Assistant Examiner*—Malina K Rustemeyer
(74) *Attorney, Agent, or Firm*—Lewis and Roca LLP

(57) ABSTRACT

A game system for playing a game between a plurality of players, the system comprising: a plurality of matching tile groupings, each one of the matching tile groupings defined by a plurality of tiles having a machine-readable identifier configured to identify its corresponding tile, wherein each one of the matching tile groupings is distinguishable from one another based on a distinct human-readable identifier disposed and viewable only on its bottom surface; a board comprising a plurality of distinct positions for placing each tile; and a scoring brick configured to: maintain each player's score, determine a penalty matching tile grouping and a bonus matching tile grouping, read the machine-readable identifier, and adjust the player's score, wherein the player's score is penalized for a penalty tile, and the player's score is rewarded for a bonus tile or for a predetermined number of consecutively read tiles.

21 Claims, 12 Drawing Sheets

METHOD AND SYSTEM FOR PLAYING A GAME WITH MATCHING PIECES AND A BONUS SCORE

BACKGROUND

Field of the Invention

The present invention relates to a memory game. More particularly, the present invention relates to a memory game involving matching pieces and bonus scores.

Memory skills, and techniques that improve them, are well understood to be integral for children's cognitive development. Improving and challenging memory skills in adults are also thought to be important elements to mental health at advanced age. Strong evidence currently suggests that memory exercises can preclude or delay the symptoms of Alzheimer's.

The classic memory game played with cards is a tool that can improve and challenge memory skills in children and adults. Both age groups, however, tend to quickly lose interest in the game. The present invention takes the classic memory game from a disposable card game to a legacy game where interest lasts for years.

SUMMARY

This patent discloses and claims a useful, novel, and unobvious invention for a memory game involving matching pieces and bonus scores.

The game of the present invention requires at least two players. In an exemplary embodiment, one or more tile sets are placed on a game board in random order face down. A scoring brick, preferably disposed on the board, is turned on and a level of play is determined. The first player turns over two tiles, or some other plurality of tiles, so that all players can see them. If the two tiles are a match, then the first player presses his/her activator button and slides one of the tiles through the scoring mechanism in the scoring brick. The scoring brick will allocate the appropriate number of points to the first player and may provide educational information regarding the topic of the tile. The tiles are kept off of the board and the first player repeats the step of turning over two tiles until the tiles are not identical. Non-matching tiles must be returned to their original position on the board. Once the first player turns over two non-matching tiles, his/her turn is over. The second player then turns over two tiles so that all players can see them in an attempt to find a match. Play continues until there are no more tiles left on the board. In a preferred embodiment, the maximum number of players, or teams, is four. However, it is contemplated that the game may accommodate any number of players greater than one.

Once all of the tiles have been turned over and removed from the board, a winner is determined. The player with the most points wins the game. Points are obtained by turning over matching tiles. Matches are more difficult to find in the beginning of the game, when there are more tiles on the board, and easier towards the end of the game, when there are fewer tiles on the board and tiles have previously been turned over and identified. Accordingly, the game is divided into periods. In a preferred embodiment, the game is divided into three periods. Matches obtained in the first period are worth a first amount of points, such as 20 points. Matches obtained in the second period are worth a second amount of points that is less than the first amount of points, such as 15 points. Matches obtained in the third period are worth a third amount of points that is less than the second amount of points, such as 10 points. The current period may be determined by the number of tiles that have been removed from play. In a game that uses 36 pairs of tiles, or 72 tiles, the first set of pairs, such as the first 12 pairs, determine the first period. The second set of pairs, such as pairs 13-24, determine the second period. Finally, the remaining tiles belong to the third period.

The game also includes bonus points based on certain events. Any player that obtains three correct matches in a row receives bonus points in addition to the usual number of points for the correct matches. The three correct matches do not necessarily have to be obtained in the same turn. For example, Player 1 may obtain two matches during one turn before obtaining a non-match. Play may then continue with no other players obtaining a match during their turn. The turn of the game returns to Player 1, who obtains a third match in a row without being interrupted by matches from any other player. This third match in a row results in bonus points, or a "Trifecta" bonus. The scoring brick may provide an announcement to all the players when one of the players has obtained two matches in a row and is capable of scoring a Trifecta. While in the preferred embodiment this bonus is applied when three consecutive uninterrupted matches are achieved, it is contemplated that the required number of matches may any number greater than one.

Within each period of the game, the scoring brick may determine and announce a bonus matching pair, or a "Wild Tile." The player who obtains the Wild Tile matching pair within the corresponding period receives bonus points in addition to the usual number of points for the correct match.

Within each period of the game, the scoring brick may determine, but does not announce a penalty matching pair, or a "Whammy." The player who obtains the Whammy matching pair within the corresponding period is informed once the player scores the tile in the brick. The Whammy is announced and the player does not receive the usual point for the matching pair. Instead, a predetermined number of points is deducted from the player's score and the player loses his/her turn.

The use of the term "pair" throughout this disclosure is intended to mean any number of matching tiles greater than two, in addition to its ordinary meaning of a set of two things.

In a preferred embodiment of the present invention a game system is disclosed for playing a game between a plurality of players. The game system comprises a plurality of matching tile groupings. Each one of the matching tile groupings is defined by a plurality of tiles having a top surface, a bottom surface opposite the top surface, and a machine-readable identifier configured to identify its corresponding tile, wherein each one of the matching tile groupings is distinguishable from one another based on a distinct human-readable identifier disposed and viewable only on the bottom surface.

The preferred embodiment further includes a board comprising a plurality of distinct positions for placing each one of the plurality of tiles with the bottom surface face-down.

The preferred embodiment also comprises a scoring brick having a memory and a processor. The scoring brick is configured to maintain a separate score for each one of the plurality of players, with each player's score being initially set to a value equal to the score of every other player. The scoring brick is also configured to determine a penalty matching tile grouping among the plurality of matching tile groupings, determine a bonus matching tile grouping among the plurality of matching tile groupings, determine which one of the plurality of players the current turn of play belongs to based on an input from the player, read the machine-readable identifier on any one of the plurality of tiles, identify the corresponding matching tile grouping based on the reading of the machine-readable identifier, associate the identified corresponding matching tile grouping with the determined player, maintain a count of how many identified matching tile groupings have been consecutively associated with the determined player before interruption from a matching tile grouping being associated with another of the plurality of players, and adjust the score of the determined player, wherein the player's score is penalized if the identified corresponding tile belongs to the penalty matching tile grouping, the player's score is rewarded if the identified corresponding tile does not belong to the penalty matching tile grouping, the player's score is rewarded if the identified corresponding tile belongs to the bonus matching tile grouping, and the player's score is rewarded if the count of consecutively associated matching tile groupings for the player is equal to a predetermined number.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

In a preferred embodiment, certain steps of the present invention are embodied in machine-executable instructions. These instructions can be used to cause a general-purpose or special-purpose processor that is programmed with the instructions to perform the steps of the present invention. Alternatively, the steps of the present invention might be performed by specific hardware components that contain hardwired logic for performing the steps, or by any combination of programmed computer components and custom hardware components.

The present invention may be provided as a computer program product that may include a machine-readable medium having stored thereon instructions that may be used to program a computer (or other electronic devices) to perform a process according to the present invention. The machine-readable medium may include, but is not limited to, floppy diskettes, optical disks, CD-ROMs, ROMs, RAMs, magnet or optical cards, or other type of media/machine-readable medium suitable for storing electronic instructions.

Various aspects of the disclosure may be described through the use of flowcharts. Often, a single instance of an aspect of the present disclosure may be shown. As is appreciated by those of ordinary skill in the art, however, the protocols, processes, and procedures described herein may be repeated continuously or as often as necessary to satisfy the needs described herein. Additionally, it is contemplated that the order of certain steps may be rearranged without departing from the scope of the present invention. Accordingly, the representation of various aspects of the present disclosure through the use of flowcharts should not be used to limit the scope of the present disclosure.

FIGS. 1 through 6B illustrate exemplary embodiments of the components of game system 2, wherein like elements are numbered alike.

Figure 1:
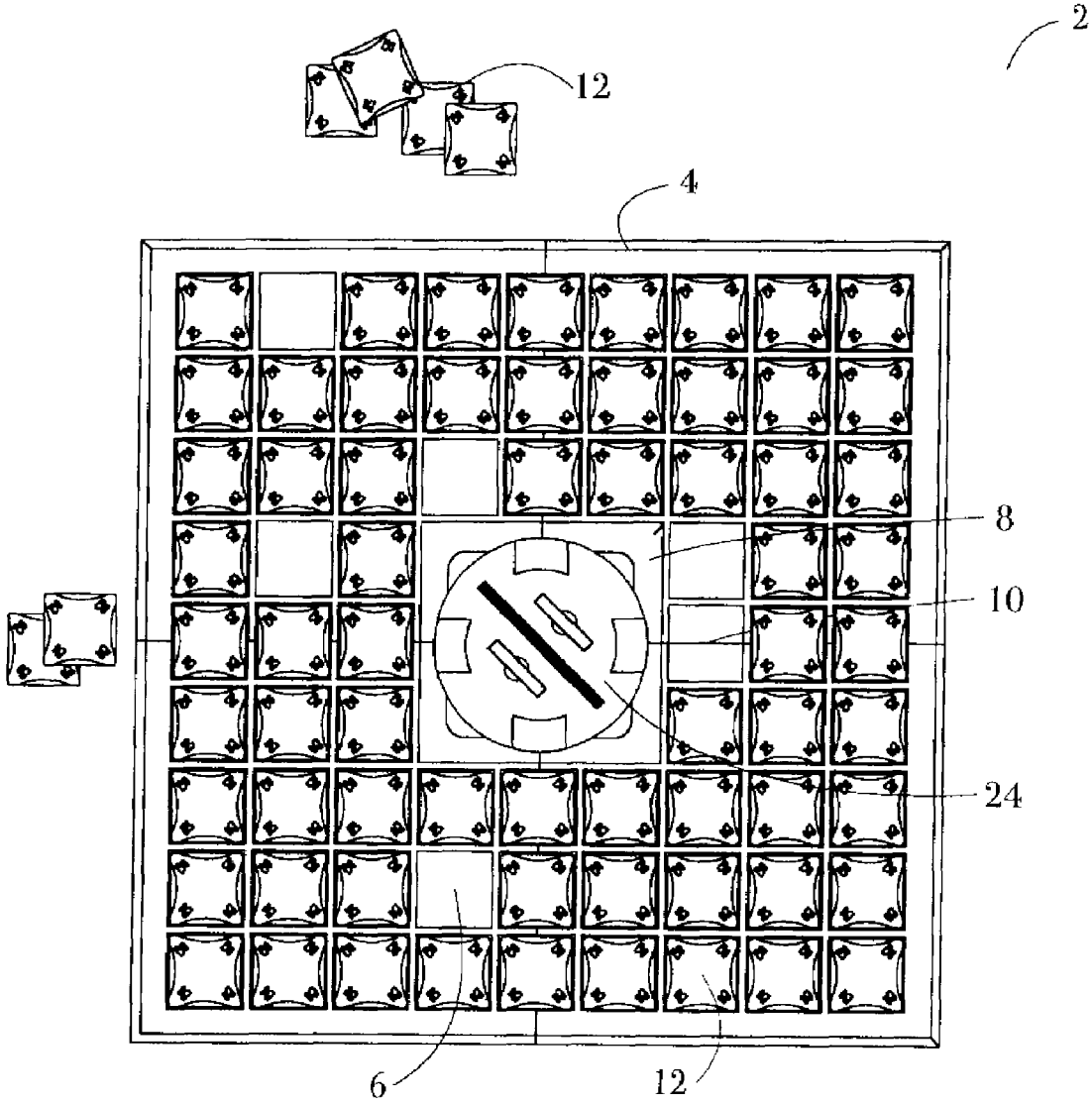
FIG. 1 is a plan view of an exemplary game system in accordance with the present invention.
Figure 2:
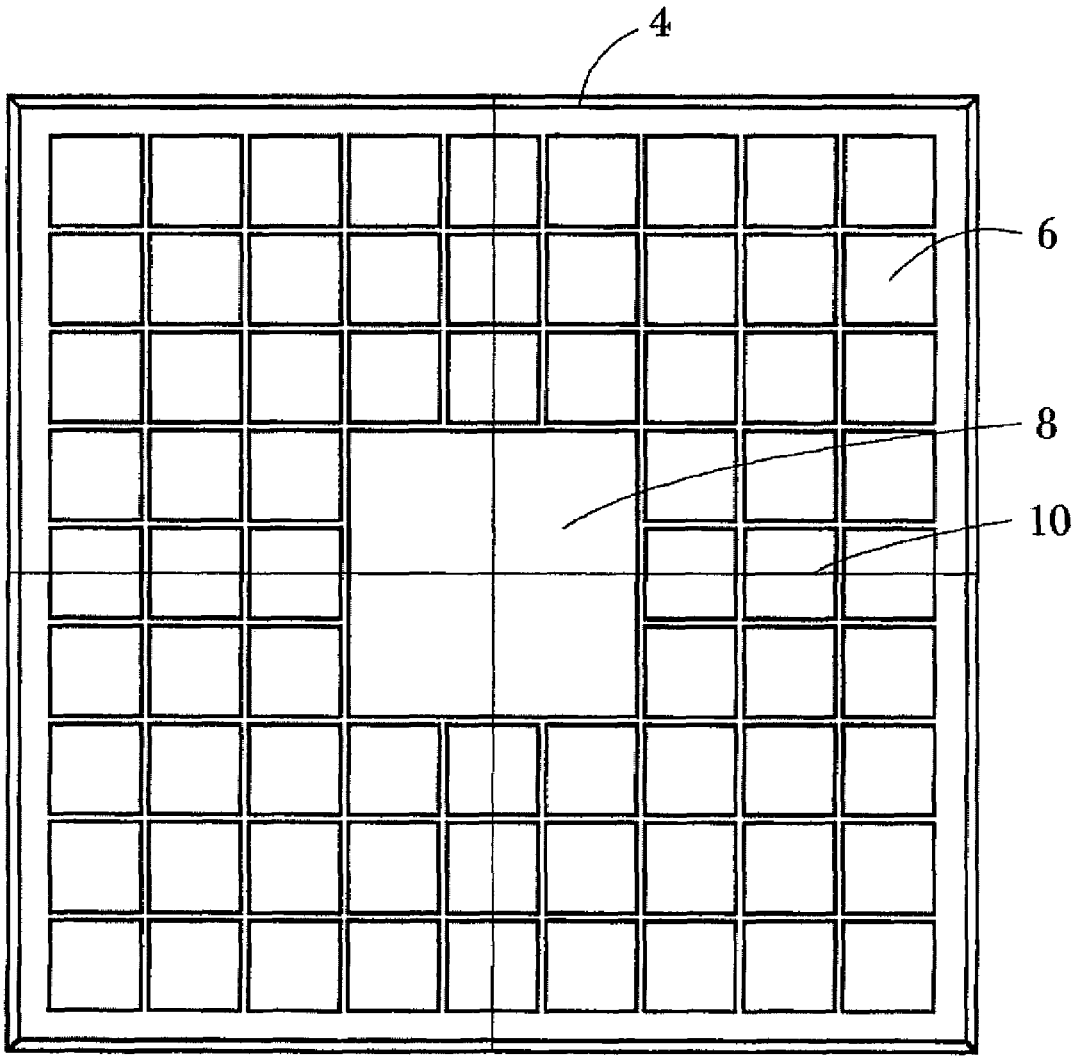
FIG. 2 is a plan view of an exemplary game board in accordance with the present invention.

FIG. 1 illustrates an exemplary embodiment of game system 2 comprising board 4, tiles 12 and scoring brick 24. As seen in FIG. 2, board 4 may comprise scoring brick seat 8 and a plurality of tile seats 6. Board 4 may be one integral structure. Alternatively, board 4 may be made up of separate pieces that can be assembled together, such as the quadrants separated by board assembly line 10. While the figures show board 4, scoring brick seat 8 and tile seats 6 as being substantially square-shaped, with tile seats 6 positioned around the perimeter of a centrally located brick seat 8, it is contemplated that the size, shape and positioning of these components may vary. Brick seat 8 may be any predetermined independent section on board 4 configured to support and maintain scoring brick 24. Similarly, tile seats 6 may be any predetermined independent sections on board 4 configured to support and maintain tiles 12.

In a preferred embodiment, board 4 comprises a raised grid structure. Each tile seat 6 may comprise a recessed area for holding a tile 12. Preferably, each recessed area has substantially the same size and shape as a single tile 12. This raised grid design gives the game a deluxe feel and helps keep tile 12 orderly. Similarly, scoring brick seat 8 may also comprise a recessed area for holding scoring brick 24. This recessed area of scoring brick seat 8 may have substantially the same size and shape as the base of scoring brick 24. Board 4 is preferably formed from a hard plastic. However, it is contemplated that board 4 may be formed from a variety of different materials.

Scoring brick 24 is an interactive mechanism configured to read tiles 12 and manage the scores of the game. Scoring brick 24 may track and display each player's score and notify the players as to whose turn it is to uncover tiles 12, as well as provide notification of other game-related events.

Figure 3:
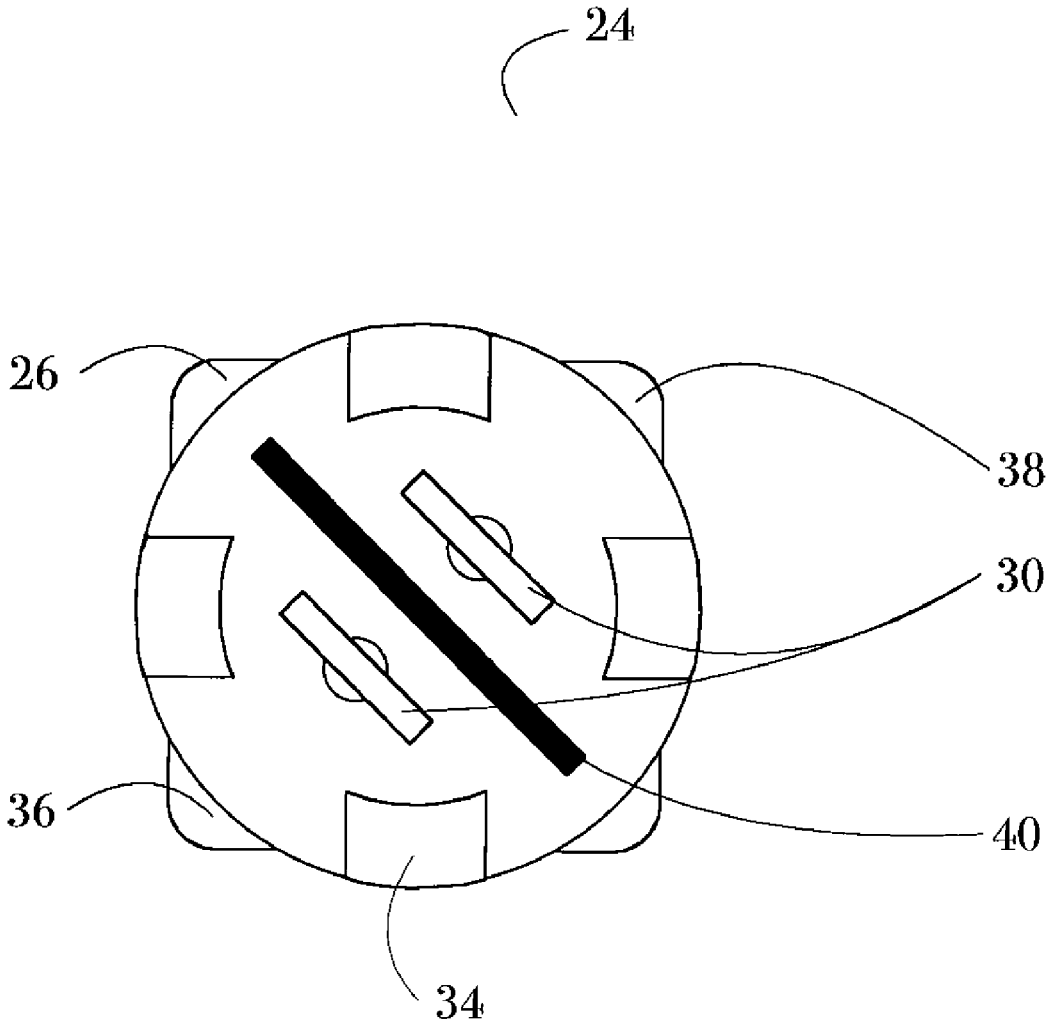
FIG. 3 is a plan view of an exemplary scoring brick in accordance with the present invention.

FIG. 3 illustrates an exemplary scoring brick 24 in accordance with the present invention. In a preferred embodiment, scoring brick 24 may be any structure configured to house a program storage device, such as memory, readable by a machine, such as a microprocessor, also housed within scoring brick 24. The program storage device (not shown) may tangibly embody a program of instructions for managing the components and operations of scoring brick 24. This program is executable by the machine (not shown). Scoring brick 24 may comprise on/off switch 26 for controlling the power to the components of scoring brick 24. The location of on/off switch 26 may vary. For example, on/off switch 26 may be located on the bottom or on the side of scoring brick 24.

Scoring brick 24 may also comprise a tile set cartridge portal 30. Tile set cartridge portal 30 may be any portal or aperture configured to receive a tile set cartridge 28 and allow scoring brick 24 to read the contents of the cartridge. Scoring brick 24 may have more than one tile set cartridge portal 30 in order to read multiple tile set cartridges 28 for multiple tile sets. The tile set cartridge 28 stores information about a particular set of tiles. Each set may be themed for a particular subject, such as popular hobbies, sports and educational subjects. For example, a tile set may be themed for a farm. A farm tile set may have pieces identified by equipment or animals. For example, a tile set may have pieces corresponding to different farm animals, such as a cow, a goat and the like. In this example, each player tries to turn over two tiles 12 having the same farm animal. If a player turns over two tiles 12 having the same farm animal, such as the cow in FIG. 4B, the player may place one of the tiles 12 into tile reader 40 on scoring brick 24.

Tile reader 40 may be any mechanism configured to receive and read tiles 12. Preferably, tile reader 40 comprises a mechanism for reading a machine-readable identifier disposed on tile 12, as will be discussed in further detail below. In FIG. 3, tile reader 40 comprises a slot that runs along the top of scoring brick 24. This configuration allows the player to slide a tile 12 through tile reader 40 so that scoring brick 24 may read the tile 12, adjust the player's score accordingly, and provide an audio and/or visual response if appropriate.

It is contemplated that tiles 12 may be formed in a variety of sizes and shapes. However, in a preferred embodiment, tiles 12 are substantially rectangular in shape, having a length and width of about 2 inches and a height of about 5/16 of an inch. As mentioned above, tiles 12 may be grouped in sets. In an exemplary embodiment, a set is made up of thirty-six tiles, having eighteen matching pairs. FIG. 1 illustrates a plan view of game system 2, where scoring brick 24 and tiles 12 are disposed on game board 4, which is configured to handle seventy-two tiles. In this example, two sets of thirty-six tiles may be used to populate tile seats 6 and play the game. As tiles 12 are matched, they are placed in a position where they are readable by tile reader 40, and then maintained someplace off of board 4.

Figure 4A:
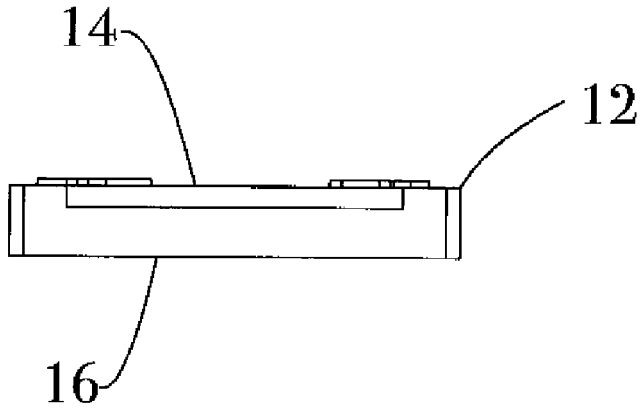
FIG. 4A is a side view of an exemplary tile in accordance with the present invention.
Figure 4B:
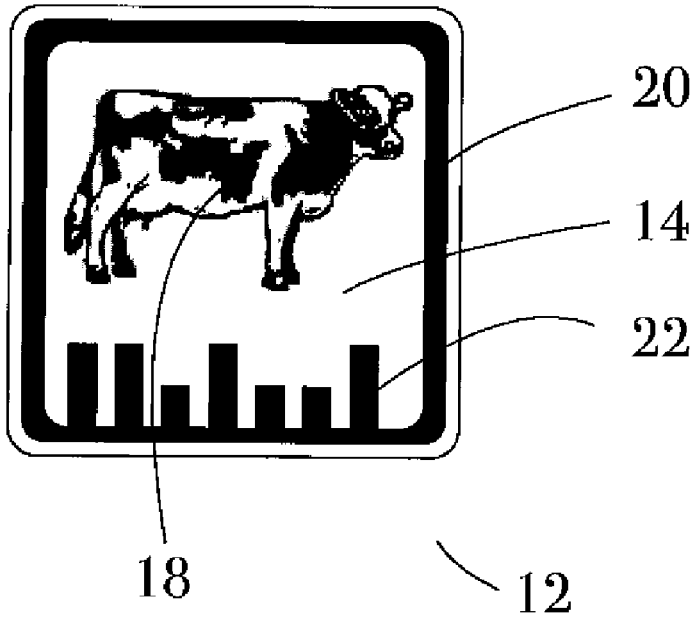
FIG. 4B is a plan view of an exemplary tile in accordance with the present invention.

As seen in FIGS. 4A-4B, tile 12 comprises a top surface 14 and a bottom surface 16 opposite the top surface 14. Top surface 14 may comprise a human-readable identifier 18, such as a tile item photo and/or a tile item name, which is preferably positioned substantially at the center of top surface 14. A tile item photo may be any picture consistent with the theme of the corresponding tile set. The tile item name may be any text consistent with the theme of the corresponding tile set and may identify the corresponding picture of the tile item photo. For example, in the farm animal tile set mentioned above, two matching tiles 12 may have a tile item name reading "COW" and a tile item photo illustrating a cow. It is contemplated that any type of human-readable indicia may be used in addition to, or as an alternative to, the tile item photo and the tile item name in order to distinguish a pair (or other grouping) of tiles 12. Additionally, each tile 12 may comprise a tile set identifier color 20 associated with the corresponding tile set. For example, each tile in a tile set directed towards a farm animal may have a tile set identifier color 20 of green, while each tile in a tile set directed towards farm equipment may have a tile set identifier color of blue. This tile set identifier color 20 may be disposed in a variety of locations on tile 12, such as along its side, covering bottom surface 16, and/or along the perimeter of top surface 14 so as to frame human-readable identifier 18.

Figure 5:
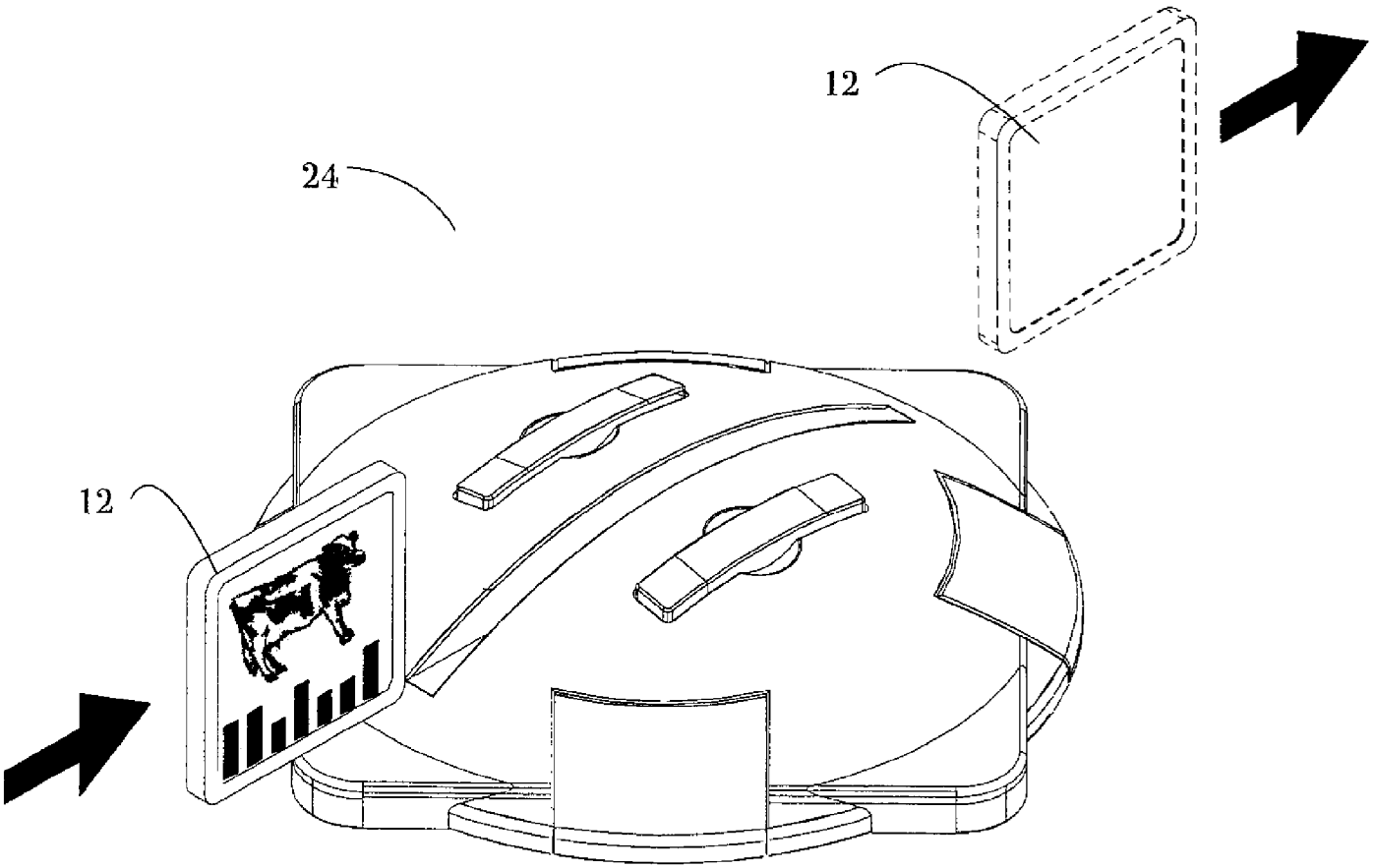
FIG. 5 is an exemplary embodiment of a tile being read by the scoring brick in accordance with the present invention.

Each tile 12 comprises a machine-readable tile identifier 22. Tile identifier 22 may be any means for enabling the identification of tiles 12 by tile reader 40 when tiles 12 are placed within reading distance of tile reader 40. Tile identifier 22 may comprise any machine-readable indicia configured to be read by tile reader 40 for identification of the corresponding tile 12. Such machine-readable indicia include, but are not limited to, mechanical means, radio frequency identification, and optical means. Accordingly, tile reader 40 and tiles 12 are configured to be compatible with each other. In a preferred embodiment illustrated in FIG. 4B, tile 12 comprises tile identifier 22 in the form of a barcode disposed along the perimeter of top surface 14. A player may slide one edge of the tile 12 through the tile reader 40, as seen in FIG. 5, thereby allowing the barcode on the tile to be scanned and read by the tile reader 40 so that the scoring brick 24 can respond accordingly. In this preferred embodiment, tile reader 40 comprises an optical scanner.

Scoring brick 24 may comprise player button 34 for each player. Each player button 34 is preferably disposed on scoring brick 24 in a position directed towards a corresponding player. For example, on a scoring brick 24 configured to handle up to four players, one player button 34 may be positioned at 90-degree intervals on the edge of scoring brick 24, as seen in FIG. 3. In an exemplary embodiment, each player must press his or her player button 34 before the player has his or her tile read in order to ensure proper scoring for the player. The activation of player button 34 allows scoring brick 24 to track each player's matches by informing the scoring brick 24 of the player with which the tile being read should be associated.

Similar to player button 34, scoring brick 24 may comprise a player score display (not shown) for each player, preferably disposed on scoring brick 24 in a position directed towards a corresponding player. When tile reader 40 reads a tile 12 and the scoring brick adjusts the player's score, the result may be displayed on this player score display. Additionally, scoring brick 24 may comprise audio/video output 38. Audio/video output 38 may produce sound and/or a visual display for responding to a tile 12 being read (i.e., a correct match). For example, a correct match may result in audio from audio/video output 38 producing a fun sound, a phrase or trivia through a speaker. The audio content may be determined and supplied by the corresponding tile set cartridge 28. A correct match may also result in a light display.

Audio/video output 38 may also be configured to respond to other situations that occur during the game. For example, if a player presses his or her player button 34 and does not place a tile 12 in position to be read by tile reader 40 within a preset time, audio/video output 38 may issue a reminder such as "Hurry up!" or "Lets go!" in order to hasten the player's action. A welcome and introduction may be announced every time the game is turned on. Affirmation yells and sounds may be delivered when bonus points are obtained. The game period may be announced along with the appropriate Wild Tile. A player's score may be announced whenever it changes. A player's score can also be prompted by the player, such as by the player pressing his/her player button 34 down for a predetermined amount of time. Additionally, the winner of the game may be announced at the end of the game.

Figure 6B:
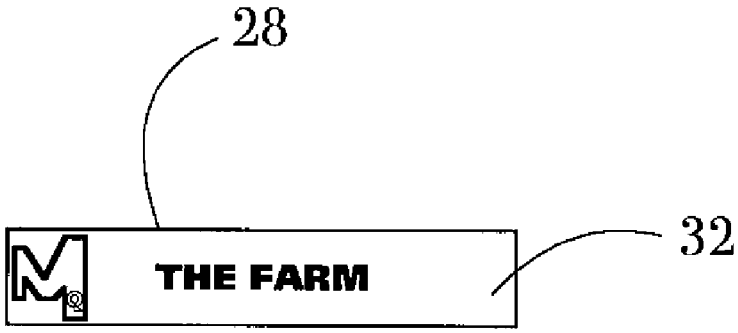
FIG. 6B is a front view of an exemplary tile set cartridge in accordance with the present invention.
Figure 6A:
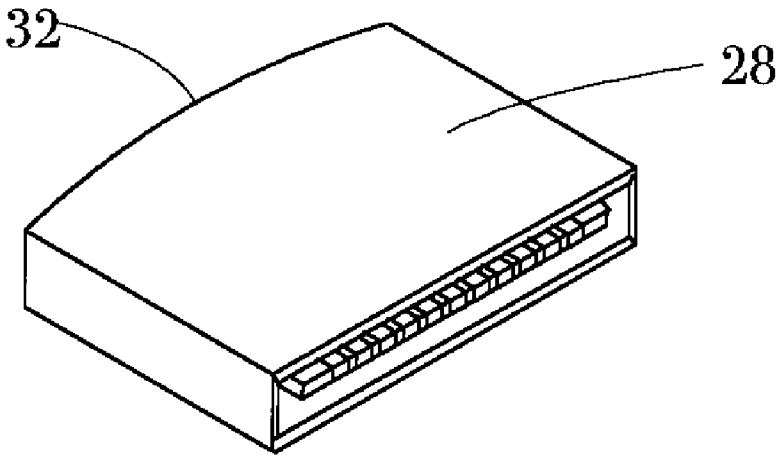
FIG. 6A is a perspective view of the back of an exemplary tile set cartridge in accordance with the present invention.

Scoring brick 24 may comprise level switch 36 for determining the level of play. Level switch 36 comprises various settings, such as a child setting and an adult setting, allowing players to customize the type of responses they will hear from correct matches of tiles 12. These responses may be generated from information stored on the corresponding tile set cartridge 28. As mentioned above, each set of tiles 12 may have a corresponding tile set cartridge 28 that stores information about the set, including an inventory of the tiles and educational responses for each tile. FIGS. 6A and 6B illustrate an exemplary embodiment of a tile set cartridge 28 in accordance with the present invention. The tile set cartridge 28 may comprise a color that corresponds to the tile set color 20 disposed on each tile 12 in the corresponding set. As seen in FIG. 6B, the front 32 of the cartridge 28 may comprise indicia that identifies the corresponding tile set. This indicia may simply be text that describes the subject area to which the tile set is related, such as sports.

Figure 7:
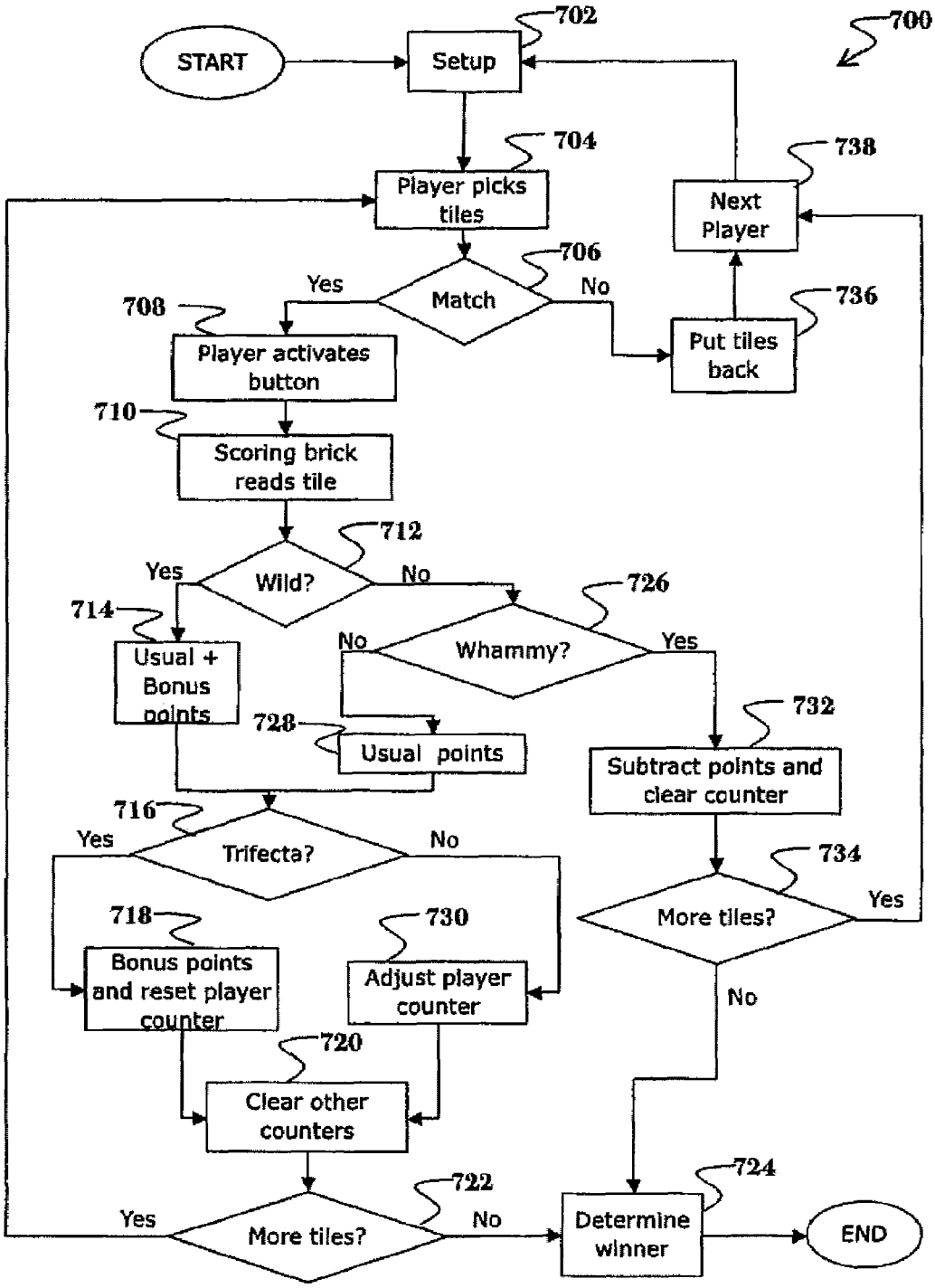
FIG. 7 is a flowchart illustrating an exemplary embodiment of the basic operation of the game in accordance with the present invention.

FIG. 7 is a flowchart illustrating an exemplary embodiment of a method 700 for playing the game of the present invention. At step 702, the game is set up. Tiles 12 and scoring brick 24 are placed in their appropriate positions on board 4, tiles 12 being placed with the human-readable identifier 18 face down. One or more tile set cartridges 28 may be placed in scoring brick 24 and scoring brick 24 is turned on. Additionally, the number of players may be determined and processed by scoring brick 24. The counters for keeping track of each player's consecutive uninterrupted matches are reset by the scoring brick 24, along with each player's score.

At step 704, the first player picks tiles 12 from board 4 and turns them over. Preferably two tiles 12 are turned over. However, it is contemplated that the number of tiles 12 being turned over for matching may vary so long as it is greater than one.

At step 706, it is determined whether or not the chosen tiles 12 are a match. If the tiles 12 are not a match, then the player places the tiles 12 back in their original position face down on the board 4 at step 736. The game then proceeds to the next players turn at step 738. The next player then continues at step 704 as previously discussed.

If the tiles 12 are a match, then the player informs the scoring brick 24 that the soon to be read tile belongs to him/her by activating his/her respective player button 34 at step 708. At step 710, the player then places one of the chosen tiles 12 within reading distance of scoring brick 24, such as by sliding tile 12 through tile reader 40, and the scoring brick 24 reads the tile 12 by using the machine-readable identifier 22 disposed on the tile.

The scoring brick 24 then determines whether or not the tile 12 is a Wild Tile for the current period at step 712. If the tile 12 is a Wild Tile, then the method proceeds to step 714 where the usual number of points and a bonus number of points are allocated to the player's score. Next, at step 716, the scoring brick 24 checks the player's counter to determine whether or not the player has turned over the predetermined number of consecutive uninterrupted matches to warrant the allocation of bonus points (i.e. whether or not the player achieved a Trifecta). If the player has achieved a Trifecta, the scoring brick 24 allocates bonus points to the player's score and resets the counter at step 718. If the player has not achieved a Trifecta, the method proceeds to step 730 where the scoring brick 24 adjusts the player's counter to reflect an additional match, such as by increasing the counter. From steps 718 and 730, the process advances to step 720 where the scoring brick 24 clears or resets the counters of the other players. At step 722, it is determined whether or not there are still more tiles 12 remaining on the board 4. If there are no more remaining tiles 12, the scoring brick 24 may determine a winner at step 724 and provide some type of audio and/or visual notification to the players of the results of the game. The game would then come to an end. If there are more remaining tiles 12 at step 722, then the method goes back to step 704 where the player repeats the process of picking tiles 12 to turn over. Before repeating step 704, the scoring brick 24 may determine the current status of the game, such as the game period, and make any necessary adjustments, such as determining a new Wild Tile, a new Whammy Tile or the current number of remaining tiles 12.

If the scoring brick 24 determines at step 712 that the chosen tile 12 is not a Wild Tile, then it is then determined at step 726 whether or not the chosen tile 12 is a Whammy Tile. If the chosen tile 12 is not a Whammy Tile, then the scoring brick 24 allocates the usual number of points to the player's score at step 728 before proceeding to a Trifecta determination at step 716 as previously discussed. If the chosen tile 12 is a Whammy Tile, then the method proceeds to step 732 where the scoring brick 24 subtracts points from the player's score and clears or resets the player's match counter. The scoring brick 24 then determines at step 734 whether or not there are any remaining tiles 12 left on the board 24. If there are no remaining tiles 12, then the scoring brick determines a winner at step 724 as previously discussed. If there are still tiles 12 remaining on the board 4, then the game advances to the next player's turn at step 738, and that player then picks tiles 12 to turn over at step 704 in an attempt to find a match.

In one embodiment of the present invention, the last pair of tiles left in the game cannot comprise a Whammy Tile. In this version of the game, the scoring brick 24 determines how many pairs of tiles are left before checking for a Wild Tile or a Whammy Tile. If there is only one pair of tiles left in the game, the scoring brick 24 can either go directly to determining the winner at step 724 or allocate the usual number of points to the player's score before determining the winner.

Figure 8:
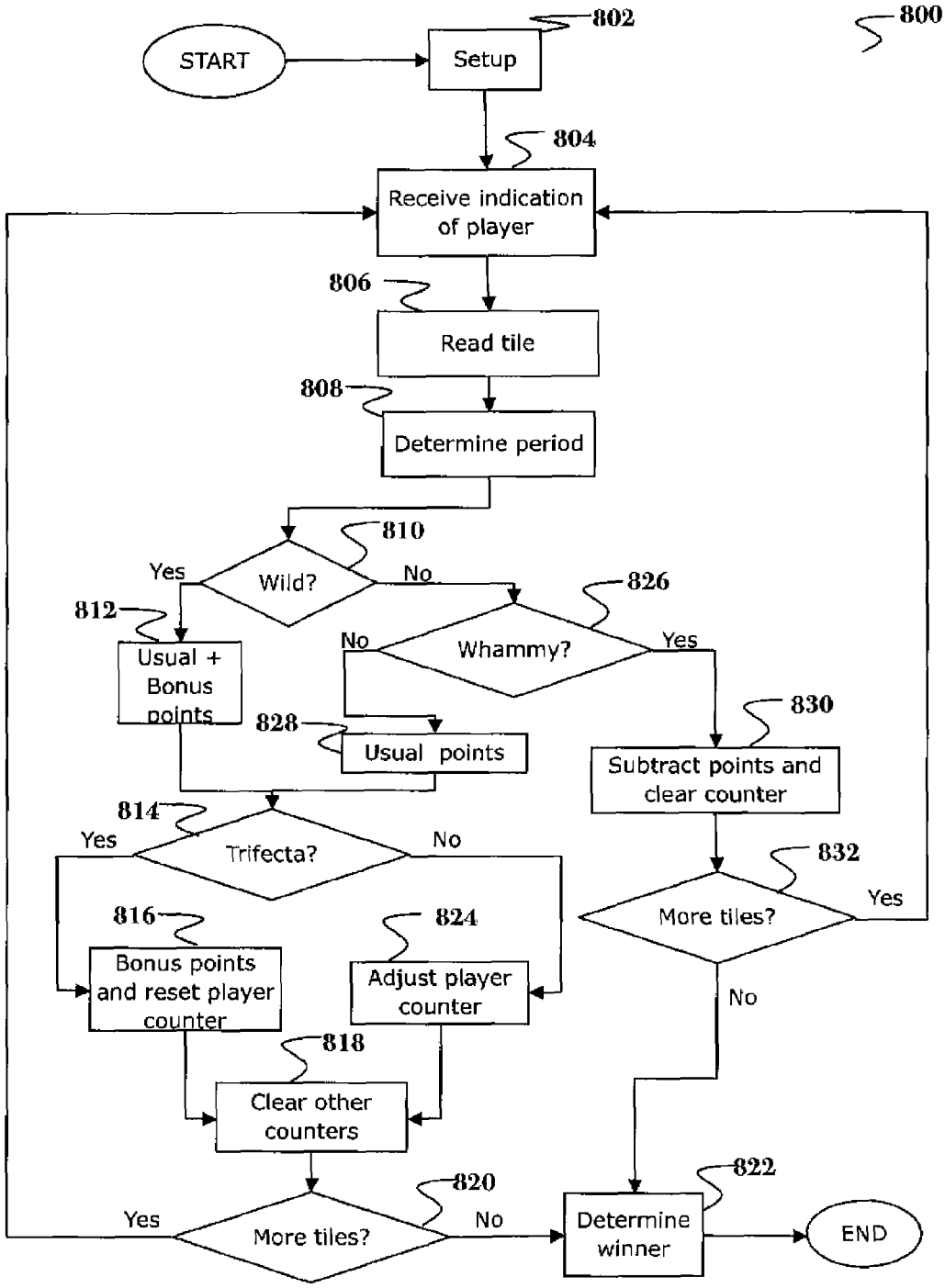
FIG. 8 is a flowchart illustrating an exemplary embodiment of the basic operation of the scoring brick during the game in accordance with the present invention.

FIG. 8 is a flowchart illustrating an exemplary embodiment of the basic operation of the scoring brick 24 during the game in accordance with the present invention. At step 802, the scoring brick 24 sets up the game. The number of players may be determined by scoring brick 24. Additionally, the counters for keeping track of each player's consecutive uninterrupted matches are reset by the scoring brick 24, along with each player's score.

At step 804, the scoring brick 24 receives and processes an indication of the player with which the soon to be read tile 12 is associated. This indication may be received through the activation of the player's respective player button 34.

At step 806, the scoring brick 24 reads the tile 12 by reading the machine-readable identifier 22 disposed on the tile 12.

At step 808, the scoring brick may determine the current game period, along with the corresponding Wild Tile and Whammy Tile.

The scoring brick 24 then determines whether or not the tile 12 is a Wild Tile for the current period at step 810. If the tile 12 is a Wild Tile, then the method proceeds to step 812 where the usual number of points and a bonus number of points are allocated to the player's score. Next, at step 814, the scoring brick 24 checks the player's counter to determine whether or not the player has turned over the predetermined number of consecutive uninterrupted matches to warrant the allocation of bonus points (i.e. whether or not the player achieved a Trifecta). If the player has achieved a Trifecta, the scoring brick 24 allocates bonus points to the player's score and resets the counter at step 816. If the player has not achieved a Trifecta, the method proceeds to step 824 where the scoring brick 24 adjusts the player's counter to reflect an additional match, such as by increasing the counter. From steps 816 and 824, the process advances to step 818 where the scoring brick 24 clears or resets the counters of the other players. At step 820, it is determined whether or not there are still more tiles 12 remaining on the board 4. If there are no more remaining tiles 12, the scoring brick 24 may determine a winner at step 822 and provide some type of audio and/or visual notification to the players of the results of the game. The game would then come to an end. If there are more remaining tiles 12 at step 820, then the method goes back to step 804 where the scoring brick 24 repeats the process by receiving an indication of the player with which the soon to be read tile 12 is associated.

If the scoring brick 24 determines at step 810 that the chosen tile 12 is not a Wild Tile, then it is then determined at step 826 whether or not the chosen tile 12 is a Whammy Tile. If the chosen tile 12 is not a Whammy Tile, then the scoring brick 24 allocates the usual number of points to the player's score at step 828 before proceeding to a Trifecta determination at step 814 as previously discussed. If the chosen tile 12 is a Whammy Tile, then the method proceeds to step 830 where the scoring brick 24 subtracts points from the player's score and clears or resets the player's match counter. The scoring brick 24 then determines at step 832 whether or not there are any remaining tiles 12 left on the board 4. If there are no remaining tiles 12, then the scoring brick determines a winner at step 822 as previously discussed. If there are still tiles 12 remaining on the board 4, then the method goes back to step 804 where the scoring brick 24 repeats the process by receiving an indication of the player with which the soon to be read tile 12 is associated.

As discussed above with respect to FIG. 7, in one embodiment of the present invention, the last pair of tiles left in the game cannot comprise a Whammy Tile. In this version of the game, the scoring brick 24 determines how many pairs of tiles are left before checking for a Wild Tile or a Whammy Tile. If there is only one pair of tiles left in the game, the scoring brick 24 can either go directly to determining the winner at step 822 or allocate the usual number of points to the player's score before determining the winner.

FIGS. 9A-9D illustrate specific exemplary embodiments of the different operations performed during the game in accordance with the present invention.

Figure 9A:
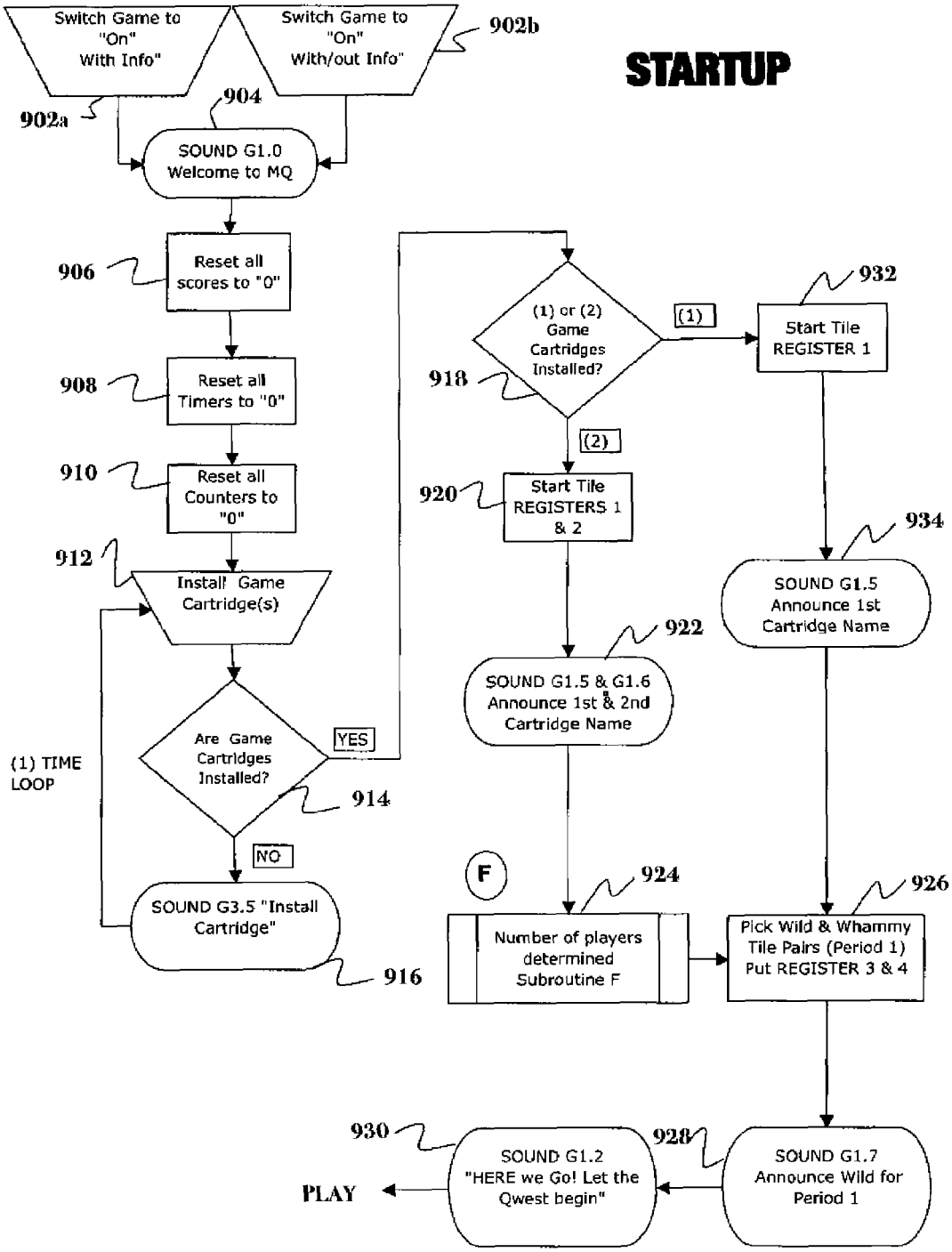
FIG. 9A is a flowchart illustrating an exemplary embodiment of the startup of the game in accordance with the present invention.

FIG. 9A is a flowchart illustrating an exemplary embodiment of the startup of the game. The game may begin either at step 902*a*, where the game is switched on and set to provide information to the players about the tiles being read by the scoring brick, or at step 902*b*, where the game is switched on without being set to provide information to the players about the tiles being read by the scoring brick. Next, at step 904, the scoring brick generates a sound to welcome the players to the game. For example, the scoring brick may provide audio that states, "Welcome to MatchQuest." At steps 906, 908 and 910, the scoring brick resets all the scores, all the timers, and the counters to zero.

At step 912, the tile set cartridges are installed into the scoring brick. The scoring brick determines at step 914 whether or not a tile set cartridge is installed. If a tile set cartridge is not installed, the scoring brick generates a sound at step 916 instructing the players to install a cartridge and the process repeats at step 912. If a tile set cartridge is installed, the scoring brick determines at step 918 how many cartridges are installed. In this example, either one or two cartridges may be installed. However, the scoring brick may be configured to accommodate any number of tile set cartridges. If one cartridge is installed, then the scoring brick starts or activates Register 1 at step 932, then generates a sound at step 934 announcing the name of the cartridge, such as "Sports." At step 926, the scoring brick then determines Wild and Whammy Tile pairs for the first period and places that information in Registers 3 and 4. The scoring brick generates a sound at step 928 announcing the Wild Tile for the first period, then generates a sound at step 930 announcing that the game has begun.

If the scoring brick determines at step 918 that two cartridges are installed, it starts or activates Registers 1 and 2 at step 920, then generates a sound at step 922 announcing the names of the cartridges. At step 924, the scoring brick may then determine the number of players playing the game by using subroutine F, which will be discussed in further detail below. The process then continues on to step 926, where the scoring brick determines a Wild Tile and a Whammy Tile for the first period as previously discussed. The play of the game may begin after the Wild Tile is announced and scoring brick informs the players that they may begin.

Figure 9B:
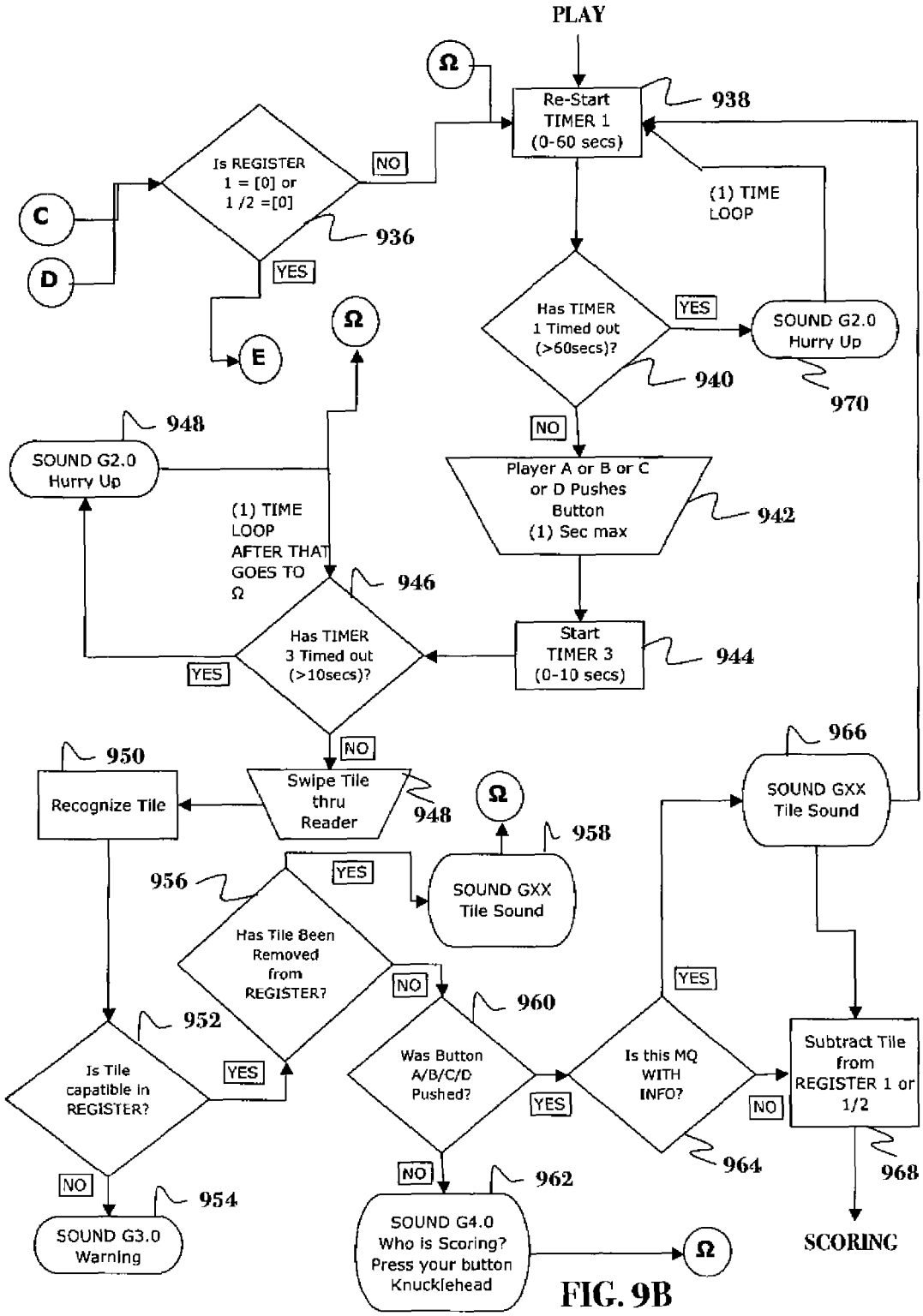
FIG. 9B is a flowchart illustrating an exemplary embodiment of the play of the game in accordance with the present invention.

FIG. 9B is a flowchart illustrating an exemplary embodiment of the play of the game. At step 938, the scoring brick re-starts Timer 1, which may run from 0 to 60 seconds. At step 940, the scoring brick determines whether or not Timer 1 has timed out (i.e. whether more than 60 seconds elapsed). If Timer 1 has timed out, then the scoring brick generates a sound at step 970 instructing the player to hurry up, then re-starts Timer 1 back at step 938. If Timer 1 has not timed out and a player button on the scoring brick has been pushed at step 942, then the scoring brick starts Timer 3 at step 944. Timer 3 may run from 0 to 10 seconds.

At step 946, the scoring brick determines whether or not Timer 3 has timed out (i.e. whether more than a preset number of seconds has elapsed). If Timer 3 has timed out, the scoring brick generates a sound at step 948 instructing the player to hurry up and swipe the tile through the tile reader so that it can be read, then loops back t step 946. In a preferred embodiment, this loop only occurs once before the process proceeds to step Q and returns to step 938.

If the scoring brick reads a tile at step 948 before Timer 3 has timed out, it proceeds to recognize the tile at step 950 and make a determination of whether or not the tile is compatible with the register of the scoring brick keeping track of all the tiles left in the game (i.e. the tile is not compatible with the tile set cartridge being used). If the tile is not compatible, then the scoring brick generates a warning sound at step 954 and corrective action may be taken, such as figuring out why the tile is incompatible and replacing it with a tile that is compatible with the tile set cartridge.

If the tile is compatible, then the scoring brick determines at step 956 whether or not the tile has been removed from the register (i.e. has the tile already been chosen and swiped through the tile reader). If the tile has been removed from the register, then the scoring brick generates a sound at step 958 informing the player that the tile has already been removed before the process proceeds to step Q and returns to step 938. If the tile has not already been removed, then the scoring brick determines at step 960 whether one of the player buttons has been activated. If a player button has not been activated, then the scoring brick generates a sound at step 962 requesting an indication of which player should be associated with the tile. The process then proceeds to step Q and returns to step 938.

If a player button has been activated, then the scoring brick determines at step 964 whether or not the current game is set to provide information about the tiles. If the game is set for providing this information, the scoring brick generates a sound at step 966 that provides this information. The scoring brick then subtracts this tile from the registers keeping track of the tiles left in the game at step 968 before proceeding to the scoring process. If the game is not set to provide information about the tiles, then it proceeds to step 968 without providing this information.

In certain circumstances, as will be discussed below, the scoring brick may check to see whether there are any tiles remaining in the game at step 936 before re-starting Timer 1 at step 938. The scoring brick may perform this operation by determining whether there are any tiles remaining in the register or registers maintaining the tile inventory for the game. Step 936 may be prompted by steps C or D, as will be discussed below. If there are tiles remaining in the game, then the process proceeds to step 938. However, if there are no more tiles remaining in the game (i.e. the inventory registers are at zero), then the process proceeds to subroutine E.

Figure 9C:
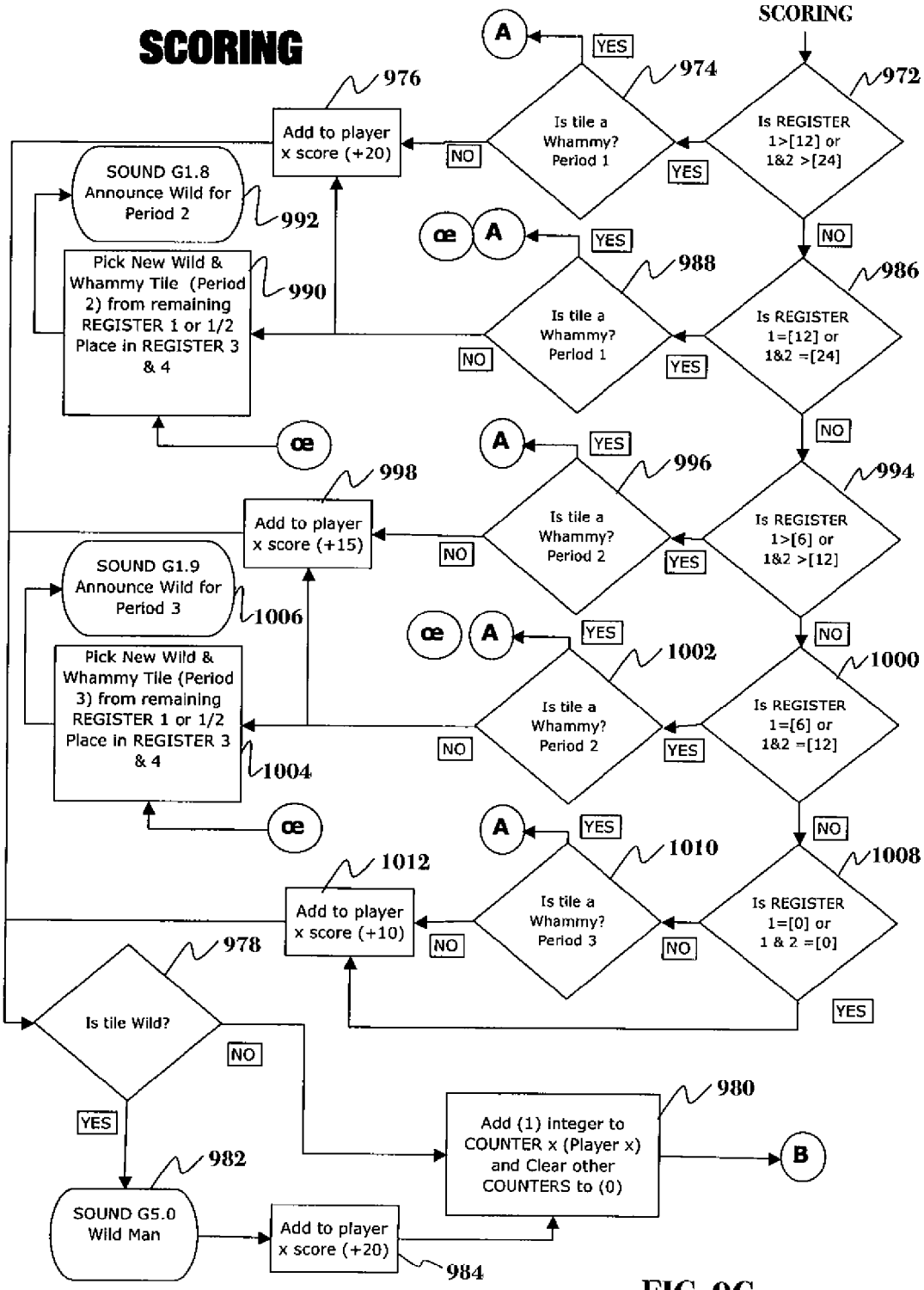
FIG. 9C is a flowchart illustrating an exemplary embodiment of the scoring of the game in accordance with the present invention.

FIG. 9C is a flowchart illustrating an exemplary embodiment of the scoring of the game. The scoring process may begin with the scoring brick determining the status of the current game. At step 972, the scoring brick determines whether the game is in the middle of the first period. If the game is employing one cartridge for one set of eighteen pairs, the scoring brick can make this determination by checking whether or not there are more than twelve pairs remaining in the tile inventory register. If the game is employing two cartridges for two sets of tiles totaling thirty-six pairs, the scoring brick can make this determination by checking whether or not there are more than twenty-four pairs remaining in the tile inventory register. If the answer to this query is no, then the scoring brick determines at step 986 whether or not the game is at the end of the first period. If the game is employing one cartridge for one set of eighteen pairs, the scoring brick can make this determination by checking whether or not there are exactly twelve pairs remaining in the tile inventory register. If the game is employing two cartridges for two sets of tiles totaling thirty-six pairs, the scoring brick can make this determination by checking whether or not there are exactly twenty-four pairs remaining in the tile inventory register. If the answer to this query is no, then the scoring brick determines at step 994 whether or not the game is in the middle of the second period.

If the game is employing one cartridge for one set of eighteen pairs, the scoring brick can make this determination by checking whether or not there are more than six pairs remaining in the tile inventory register. If the game is employing two cartridges for two sets of tiles totaling thirty-six pairs, the scoring brick can make this determination by checking whether or not there are more than twelve pairs remaining in the tile inventory register. If the answer to this query is no, then the scoring brick determines at step 1000 whether or not the game is at the end of the second period. If the game is employing one cartridge for one set of eighteen pairs, the scoring brick can make this determination by checking whether or not there are exactly six pairs remaining in the tile inventory register. If the game is employing two cartridges for two sets of tiles totaling thirty-six pairs, the scoring brick can make this determination by checking whether or not there are exactly twelve pairs remaining in the tile inventory register. If the answer to this query is no, then the scoring brick determines at step 1008 whether or not the game is at the end of the third period. If the game is employing one cartridge for one set of eighteen pairs or two cartridges for two sets of tiles totaling thirty-six pairs, the scoring brick can make this determination by checking whether or not there are exactly zero tiles remaining in the tile inventory register.

At step 972, if the game is in the middle of the first period, the scoring brick then determines at step 974 whether the tile being read is the Whammy Tile of the first period. If the read tile is the Whammy Tile, then the process proceeds to subroutine A, which will be discussed in further detail below. If the read tile is not the Whammy Tile, then the scoring brick adds a certain number of points, such as 20, to the player's score at step 976.

The scoring brick then determines at step 978 whether or not the read tile is the Wild Tile for the current period. If the tile is the Wild Tile, then the scoring brick generates a sound informing the player of this event before adding a bonus amount of points, such as 20, to the player's score at step 984. At step 980, the scoring brick increases the player's counter and clears, or resets, the other players' counters. The process then continues to subroutine B, which will be discussed in further detail below.

At step 986, if the game is at the end of the first period, the scoring brick then determines at step 988 whether the tile being read is the Whammy Tile of the first period. If the read tile is the Whammy Tile, then the process proceeds to subroutine A. Additionally, the scoring brick performs subroutine œ at step 990. At step 990, the scoring brick selects a new Wild Tile and a new Whammy Tile for the second period from the tiles remaining in the tile inventory register(s). The scoring brick may place this newly determined information in registers for later access and generate a sound at step 992 announcing the Wild Tile for the second period. If the read tile is not the Whammy Tile, then the scoring brick adds a certain number of points, such as 20, to the player's score at step 976 as previously discussed. Additionally, the scoring brick selects a new Wild Tile and a new Whammy Tile for the second period from the tiles remaining in the tile inventory register(s) at step 990 as previously discussed.

At step 994, if the game is in the middle of the second period, the scoring brick then determines at step 996 whether the tile being read is the Whammy Tile of the second period. If the read tile is the Whammy Tile, then the process proceeds to subroutine A, which will be discussed in further detail below. If the read tile is not the Whammy Tile, then the scoring brick adds a certain number of points, such as 15, to the player's score at step 998. This number of points is preferably lower than the corresponding number of points in the first period since the odds of finding a correct match in the second period are better than the odds of finding a match in the first period. The scoring brick then determines at step 978 whether or not the read tile is the Wild Tile for the current period, as previously discussed.

At step 1000, if the game is at the end of the second period, the scoring brick then determines at step 1002 whether the tile being read is the Whammy Tile of the second period. If the read tile is the Whammy Tile, then the process proceeds to subroutine A. Additionally, the scoring brick performs subroutine œ at step 1004. At step 1004, the scoring brick selects a new Wild Tile and a new Whammy Tile for the third period from the tiles remaining in the tile inventory register(s). The scoring brick may place this newly determined information in registers for later access and generate a sound at step 1006 announcing the Wild Tile for the third period. If the read tile is not the Whammy Tile, then the scoring brick adds a certain number of points, such as 15, to the player's score at step 998 as previously discussed. Additionally, the scoring brick selects a new Wild Tile and a new Whammy Tile for the second period from the tiles remaining in the tile inventory register(s) at step 1004 as previously discussed.

At step 1008, if the game is in the middle of the third period, the scoring brick then determines at step 1010 whether the tile being read is the Whammy Tile of the third period. If the read tile is the Whammy Tile, then the process proceeds to subroutine A, which will be discussed in further detail below. If the read tile is not the Whammy Tile, then the scoring brick adds a certain number of points, such as 10, to the player's score at step 1012. This number of points is preferably lower than the corresponding number of points in the first and second periods since the odds of finding a correct match in the third period are better than the odds of finding a match in the first period or the second period. The scoring brick then determines at step 978 whether or not the read tile is the Wild Tile for the current period, as previously discussed.

At step 1008, if the game is at the end of the third period, then the scoring brick adds a certain number of points to the player's score at step 1012, as previously discussed, before proceeding to step 978.

Figure 9D:
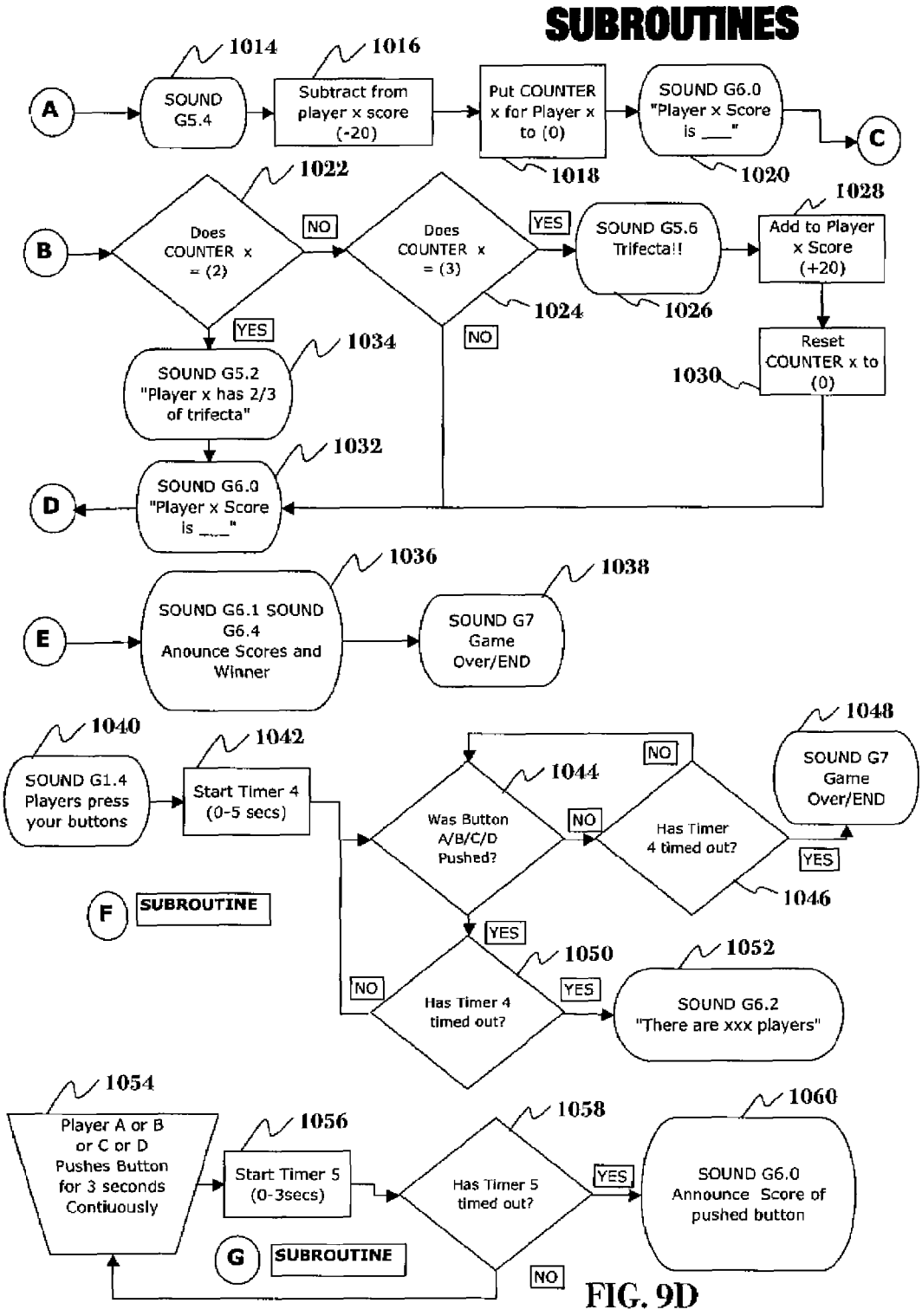
FIG. 9D is a flowchart illustrating an exemplary embodiment of subroutines used throughout the game in accordance with the present invention.

FIG. 9D is a flowchart illustrating an exemplary embodiment of the previously mentioned subroutines used throughout the game in accordance with the present invention.

Subroutine A is directed towards the situation of a player causing a Whammy Tile to be read by the tile reader. Subroutine A begins at step 1014, where the scoring brick generates a sound informing the player that the tile he/she has swiped through the reader is a Whammy Tile. The scoring brick then subtracts a certain number of points, such as 20, from the score of the player who turned over the tile at step 1016. Next, the scoring brick resets the player's counter to zero at step 1018, thereby interrupting his/her consecutive matches. Finally, the scoring brick may generate a sound at step 1020 informing the player of his/her score before proceeding to step C. Step C leads to step 936 in FIG. 9B, where the scoring brick determines whether or not there are any more tiles remaining in the game as previously discussed.

Subroutine B is directed towards the situation of the scoring brick determining whether a player has scored a Trifecta or how close a player is to scoring a Trifecta. Subroutine B begins at step 1022, where the scoring brick determines whether or not the player's counter is equal to 2 (i.e. whether the number of consecutive uninterrupted matches the player has turned over is 2). If the player's counter does equal 2, the scoring brick generates a sound at step 1034 that informs the player of how close he/she is to scoring the Trifecta. The scoring brick then generates a sound at step 1032 informing the player of his/her current score before proceeding to step D.

If the player's counter does not equal 2 at step 1022, then the scoring brick determines at step 1024 whether or not the player's counter equals 3. If the player's counter does not equal 3, then the scoring brick generates a sound at step 1032 informing the player of his/her current score before proceeding to step D. If the player's counter does equal 3, then the scoring brick generates a sound at step 1026 informing the player that he/she has scored a Trifecta. The scoring brick then adds the bonus amount of points, such as 20, to the player's score at step 1028. The scoring brick resets the player's counter to 0 at step 1030 and then generates a sound at step 1032 informing the player of his/her current score before proceeding to step D.

Subroutine E begins at step 1036, where the scoring brick determines the winner of the game at step 1036 based on each player's score and announces each player's score along with the winner of the game. The scoring brick then generates a sound at step 1038 informing the players that the game is over.

Subroutine F is directed towards determining the number of players for the game. Subroutine F begins at step 1040, where the scoring brick generates a sound instructing the players to activate their respective buttons. The scoring brick then starts a timer, such as Timer 4, at step 1042. The timer runs for a predetermined amount of time, such as 5 seconds. The scoring brick then determines at step 1044 whether any of the player buttons have been activated. If no player buttons have been activated, then the scoring brick determines at step 1046 whether or not the timer has timed out (i.e. whether the predetermined amount of time has elapsed). If the timer has timed out, then the scoring brick generates a sound at step 1048 announcing that the game is over. If the timer has not timed out, then the process repeats step 1044, with the scoring brick determining whether any of the player buttons have been activated.

If any of the player buttons have been activated at step 1044, the scoring brick then determines whether or not the timer has timed out at step 1050, keeping track of any player buttons that have been activated during the running of the timer. If the timer has not timed out, the timer continues to run while the scoring brick again determines at step 1044 which, if any, player buttons have been activated. Once the timer has timed out, the scoring brick generates a sound at step 1052 announcing how many players there are in the game based on which player buttons were activated during the running of the timer.

Subroutine F represents only one way of determining how many players will be playing the game. It is contemplated that other means for determining the number of players may be used as well, including, but not limited to, use of a switch or a set of buttons disposed on the scoring brick.

Subroutine G is directed towards the situation where a player requests that his/her score be announced. Subroutine G begins at step 1054, where a player that wants to find out his/her score activates his/her button for a continuous amount of time, such as 3 seconds. Upon button activation, the scoring brick starts a timer, such as Timer 5, at step 1056. The timer runs for the above-mentioned continuous amount of time before timing out. At step 1058, the scoring brick determines whether or not the timer has timed out (i.e. whether the continuous amount of time has elapsed). If the timer has not timed out, then the timer continues to run as the player's button continues to be activated at step 1054. If the timer times out while the player button is still activated, then the scoring brick generates a sound at step 1060 announcing the score of the player associated with the activated player button.

The scoring brick may comprise a memory and microprocessor for carrying out all of the games operations, such as managing scores, timers, counters, the tile reader, lights, buttons, switches, sounds, and registers communicating with the chip set cartridges and accounting for all the tiles in the sets being used in the game. The term "memory" may include the chip set cartridges, in addition to any other machine-readable medium configured to store information.

While this disclosure states that points are subtracted in certain situations and points are added in other situations, these terms are used to reflect that a player is penalized when obtaining a Whammy Tile match and rewarded when obtaining a non-Whammy Tile match, a Wild Tile match, or a Trifecta. The actual mathematical operations used by the scoring brick in order to reflect this penalty/reward system may vary.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A game system for playing a game between a plurality of players, said system comprising:

a plurality of matching tile groupings, each one of said matching tile groupings defined by a plurality of tiles having a top surface, a bottom surface opposite said top surface, and a machine-readable identifier configured to identify its corresponding tile, wherein each one of said matching tile groupings is distinguishable from one another based on a distinct human-readable identifier disposed and viewable only on said bottom surface;

a board comprising a plurality of distinct positions for placing each one of said plurality of tiles with said bottom surface face-down; and a scoring brick having a memory and a processor, said scoring brick configured to:

maintain a separate score for each one of said plurality of players, each player's score being initially set to a value equal to the score of every other player, determine a penalty matching tile grouping among said plurality of matching tile groupings, determine a bonus matching tile grouping among said plurality of matching tile groupings, determine which one of said plurality of players the current turn of play belongs to based on an input from said one of said plurality of players, read said machine-readable identifier on any one of said plurality of tiles, identify the corresponding matching tile grouping based on said reading of said machine-readable identifier, associate the identified corresponding matching tile grouping with said one of said plurality of players, maintain a count of how many identified matching tile groupings have been consecutively associated with said one of said plurality of players before interruption from a matching tile grouping being associated another of said plurality of players, and adjust the score of said one of said plurality of players, wherein the player's score is penalized if the identified corresponding tile belongs to said penalty matching tile grouping, the player's score is rewarded if the identified corresponding tile does not belong to said penalty matching tile grouping, the player's score is rewarded if the identified corresponding tile belongs to said bonus matching tile grouping, and the player's score is rewarded if said count of consecutively associated matching tile groupings for said player is equal to a predetermined number.

2. The game system of claim 1, wherein said human-readable identifier comprises a picture and/or text.

3. The game system of claim 2, wherein said scoring brick is further configured to generate audio providing information about a subject corresponding to said human-readable identifier.

4. The game system of claim 2, wherein said scoring brick is further configured to determine when each one of said plurality of matching tile groupings has been read and identified.

5. The game system of claim 4, wherein said memory includes a removable tile set cartridge, said removable tile set cartridge storing identification information about each one of said plurality of matching tile groupings.

6. The game system of claim 4, wherein said scoring brick is further configured to determine a winner when each one of said plurality of matching tile groupings has been read and identified, said winner being the player having the most rewarded score.

7. The game system of claim 6, wherein said scoring brick is further configured to provide audio and/or visual output announcing the winner.

8. The game system of claim 2, wherein said scoring brick comprises a tile reader operationally coupled to said processor and configured to read said machine-readable identifier on each one of said plurality of tiles.

9. The game system of claim 8, wherein said machine-readable identifier is a barcode and said tile reader comprises an optical scanner configured to read said barcode.

10. The game system of claim 9, wherein said tile reader comprises a slot configured to receive the portion of said tile on which said machine-readable identifier is disposed, such that said tile reader may read said machine-readable identifier when said portion passes through said slot.

11. The game system of claim 2, wherein said scoring brick is further configured to:

divide the game into a plurality of periods;

determine how many of said matching tile groupings have been read; and determine the current period based on the number of matching tile groupings that have been read.

12. The game system of claim 11, wherein said plurality of periods comprises:

a first period;

a second period occurring after said first period, the reward for the identified corresponding tile not belonging to said penalty matching tile grouping being greater during the first period than during the second period; and a third period occurring after said second period, the reward for the identified corresponding tile not belonging to said penalty matching tile grouping being greater during the second period than during the third period.

13. The game system of claim 2, wherein:

said penalty for the identified corresponding tile belonging to said penalty matching tile grouping is the subtraction of points from the player's score;

the reward for the identified corresponding tile not belonging to said penalty matching tile grouping is the addition of points to the player's score;

the reward for the identified corresponding tile belonging to said bonus matching tile grouping is the addition of points to the player's score; and the reward for said count of consecutively associated matching tile groupings for said player being equal to said predetermined number is the addition of points to the player's score.

14. The game system of claim 2, wherein said scoring brick comprises a player button for each one of said plurality of players, each player button operationally coupled to said processor and configured to provide said input for determining to which one of said plurality of players the current turn of play belongs.

15. The game system of claim 2, wherein said scoring brick resets said count of how many identified matching tile groupings have been consecutively associated with said one of said plurality of players when said predetermined number has been reached.

16. The game system of claim 15, wherein said predetermined number is three.

17. The game system of claim 2, wherein each of said matching tile groupings is defined by two tiles.

18. The game system of claim 2, wherein each one of said plurality of tiles is substantially rectangular in shape.

19. The game system of claim 18, wherein said distinct positions are arranged on said board s as to form a substantially rectangular shape.

20. The game system of claim 19, wherein said board comprises a distinct position identified for placing said scoring brick.

21. The game system of claim 19, wherein said plurality of matching tile groupings comprises at least 36 matching tile groupings.

* * * * *